US009727015B2

(12) United States Patent
Amit et al.

(10) Patent No.: US 9,727,015 B2
(45) Date of Patent: Aug. 8, 2017

(54) PRINTING WITH CONTINUOUS COLOR CALIBRATION

(71) Applicant: Hewlett-Packard Development Company, L.P., Houston, TX (US)

(72) Inventors: Gal Amit, Bat Yam (IL); Tsafrir Yedid-Am, Jerusalem (IL); Eyal Shelef, Tel-Aviv (IL); Ran Waidman, Rehovot (IL); Shlomo Harush, Nes-Ziona (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/151,233

(22) Filed: May 10, 2016

(65) Prior Publication Data

US 2016/0252862 A1 Sep. 1, 2016

Related U.S. Application Data

(63) Continuation of application No. 14/001,864, filed as application No. PCT/US2011/026520 on Feb. 28, 2011, now abandoned.

(51) Int. Cl.

| | |
|---|---|
| ***G03G 15/00*** | (2006.01) |
| ***G03G 15/01*** | (2006.01) |
| *G03G 15/10* | (2006.01) |

(52) U.S. Cl.

CPC ..... *G03G 15/55* (2013.01); *G03G 15/01* (2013.01); *G03G 15/5058* (2013.01); *G03G 15/10* (2013.01); *G03G 2215/00042* (2013.01); *G03G 2215/00063* (2013.01); *G03G 2215/0106* (2013.01)

(58) Field of Classification Search

CPC ..... G03G 15/5062; G03G 15/01

See application file for complete search history.

(56) References Cited

U.S. PATENT DOCUMENTS

| | | | |
|---|---|---|---|
| 5,258,925 | A | 11/1993 | Maier et al. |
| 5,555,102 | A | 9/1996 | Dalton |
| 6,157,469 | A | 12/2000 | Mestha |
| 6,178,007 | B1 | 1/2001 | Harrington |
| 6,351,308 | B1 | 2/2002 | Mestha |
| 6,591,021 | B1 | 7/2003 | Breiter et al. |
| 6,594,028 | B1 | 7/2003 | Hamamoto et al. |
| 6,803,933 | B1 | 10/2004 | Staelin et al. |
| 7,355,606 | B2 | 4/2008 | Paquette |
| 7,486,414 | B2 | 2/2009 | Arai |
| 7,860,411 | B2 | 12/2010 | Toda |
| 8,332,176 | B2 | 12/2012 | Custode et al. |

(Continued)

FOREIGN PATENT DOCUMENTS

| | | |
|---|---|---|
| CN | 1694488 | 11/2005 |
| CN | 101713942 | 5/2010 |

(Continued)

*Primary Examiner* — David M Gray
*Assistant Examiner* — Geoffrey T Evans
(74) *Attorney, Agent, or Firm* — HP Inc. Patent Department

(57) ABSTRACT

Printing by determining target color values based on first color outputs, determining current color values based on current color outputs, and calculating color compensation values to compensate for a difference between the target color values and the current color values.

10 Claims, 4 Drawing Sheets

(56) References Cited

U.S. PATENT DOCUMENTS

| | | | | |
|---|---|---|---|---|
| 9,019,560 | B2 | 4/2015 | Yasukawa et al. | |
| 2004/0165199 | A1 | 8/2004 | Klassen et al. | |
| 2005/0093923 | A1 | 5/2005 | Busch et al. | |
| 2005/0117925 | A1 | 6/2005 | Tanaka et al. | |
| 2005/0248789 | A1 | 11/2005 | Kita et al. | |
| 2006/0062617 | A1 | 3/2006 | Yamasaki | |
| 2007/0097440 | A1 | 5/2007 | Majewicz | |
| 2007/0139734 | A1 | 6/2007 | Fan et al. | |
| 2007/0177231 | A1 | 8/2007 | Wang et al. | |
| 2008/0007802 | A1 | 1/2008 | Viturro et al. | |
| 2008/0165379 | A1 | 7/2008 | Zuber | |
| 2008/0246978 | A1 | 10/2008 | Braveman et al. | |
| 2009/0307298 | A1 | 12/2009 | Jaiswal et al. | |
| 2010/0054769 | A1 | 3/2010 | Adiletta et al. | |
| 2010/0086201 | A1 | 4/2010 | Muto et al. | |
| 2012/0026517 | A1 | 2/2012 | Gross et al. | |
| 2012/0162676 | A1 | 6/2012 | Dorfner | |
| 2012/0314232 | A1 | 12/2012 | Barkai et al. | |
| 2013/0330092 | A1 | 12/2013 | Amit et al. | |
| 2015/0138571 | A1 | 5/2015 | Amit et al. | |
| 2016/0132011 | A1* | 5/2016 | Shibuya ..... | H04N 1/00068 358/1.1 |

FOREIGN PATENT DOCUMENTS

| | | |
|---|---|---|
| JP | 2002199235 | 7/2002 |
| KR | 20030038516 | 5/2003 |
| KR | 20100048693 | 5/2010 |
| WO | WO-2011009921 | 1/2011 |

* cited by examiner

PRINTING WITH CONTINUOUS COLOR CALIBRATION

CROSS-REFERENCE TO RELATED APPLICATIONS

This is a Continuation of U.S. application Ser. No. 14/001,864 (U.S. Publication 2013/0336666), filed on 27 Aug. 2013, which is a national stage application under 35 U.S.C. § of PCT/US2011/026520 (Publication WO2012118479), filed on 28 Feb. 2011, both of which are incorporated herein by reference in their entireties for all purposes.

BACKGROUND OF THE INVENTION

In print systems, certain components may change state during the lifetime and usage of the print system. Certain print component states such as temperatures, sheet material properties, electrical resistances, ink properties, toner properties such as conductivities and densities, binary ink developer properties, and/or other states may change during the lifetime of a printer. These changes can affect a printer's color output. To maintain a better control of the color output, most printers are regularly calibrated. Some printers undergo full color calibrations after having printed certain amounts of sheets. For example, some digital presses run a full color calibration approximately every 10.000 or 20.000 printed sheets to improve the alignment of the digital input with the color output.

BRIEF DESCRIPTION OF THE DRAWINGS

For the purpose of illustration, certain embodiments of the present invention will now be described with reference to the accompanying diagrammatic drawings, in which.

DETAILED DESCRIPTION

In the following detailed description, reference is made to the accompanying drawings. The embodiments in the description and drawings should be considered illustrative and are not to be considered as limiting to the specific embodiment of element described. Multiple embodiments may be derived from the following description and/or drawings through modification, combination or variation of certain elements. Furthermore, it may be understood that also embodiments or elements that are not literally disclosed may be derived from the description and drawings by a person skilled in the art.

Figure 1:
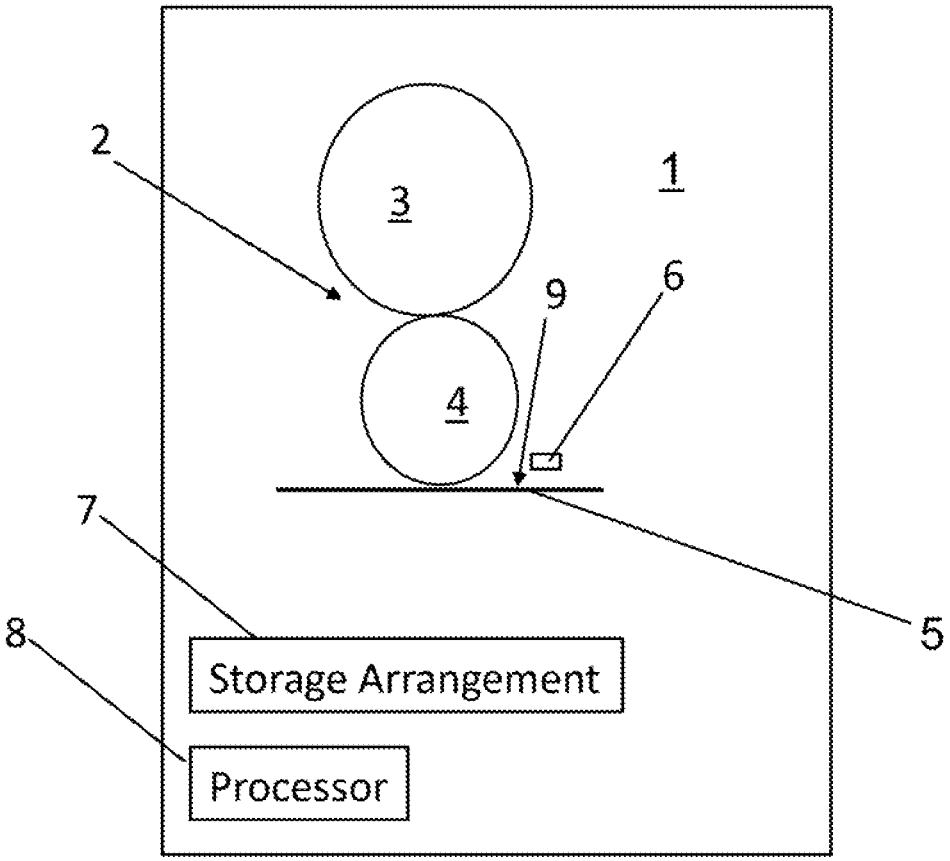
FIG. 1 illustrates a diagram of an embodiment of a print system.

FIG. 1 shows a print system 1 for printing sheets 5. The print system 1 may be any type of printer or press, for example any type of offset printer or press. In an embodiment, the print system 1 comprises a digital press, for example a liquid or dry electrophotographic digital press. The sheets 5 for printing may comprise any print medium such as paper.

The print system 1 comprises an image transfer arrangement 2. In an embodiment, the image transfer arrangement 2 comprises a developer drum 3 and an image transfer drum 4 for imprinting liquid toner onto the sheets 5. In other embodiments, the image transfer arrangement 2 comprises dry toner drums, offset printing drums or a print head.

The print system 1 comprises an image sensor 6, arranged to measure color outputs 9 printed on the sheets 5. The print system 1 further comprises a storage arrangement 7 and a processor 8.

In an embodiment, the processor 8 comprises, or is part of, a print system controller. In another embodiment, the processor 8 is part of a component or subcomponent of the print system 1, for example the image sensor 6. The processor 8 is configured to signal the image transfer arrangement 2 for printing color outputs 9.

In an embodiment, the storage arrangement 7 comprises a non-volatile memory. The storage arrangement 7 stores color values configured to convert digital inputs to the color outputs. In an embodiment, the color values comprise pre-calibrated color values obtained during a full color calibration of the print system 1. The full color calibration couples digital inputs to color outputs. The pre-calibrated color values may comprise at least one machine LUT. In a normal operational mode of an embodiment of a print system 1, the machine LUT may be used to couple digital inputs to respective color outputs for each print.

In a normal operational mode of a print system 1, the processor 8 may receive desired color outputs as read from an input digital image, and provide the corresponding digital inputs to the image transfer arrangement 2 in accordance with the machine LUT. In a continuous color calibration (CCC) mode, the processor 8 may provide digital inputs to the image transfer arrangement 2 in accordance with a color compensation value, as will be explained below.

Figure 2:
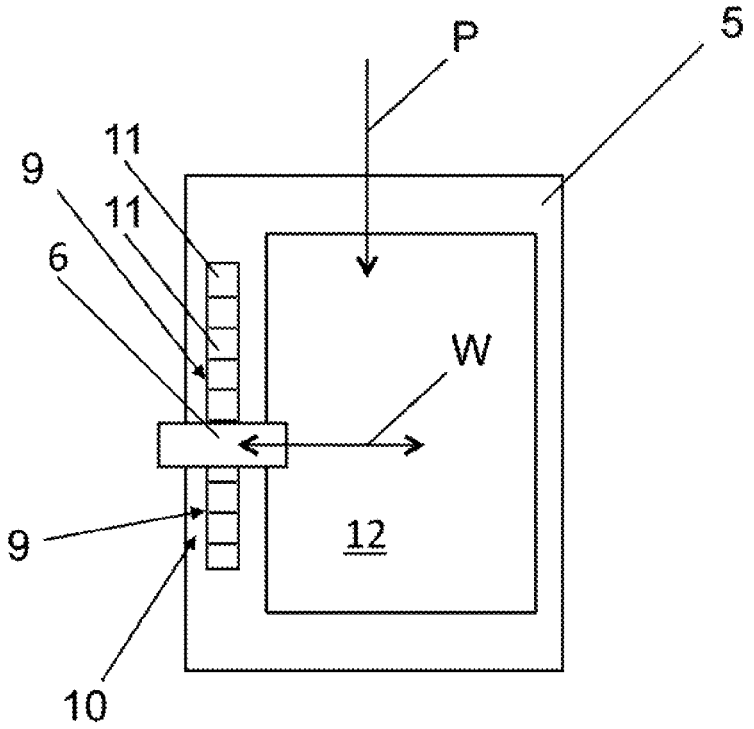
FIG. 2 illustrates a diagram of an embodiment of a printed sheet including color outputs, and an image sensor for measuring the color outputs, in top view.

FIG. 2 shows an example of a printed sheet 5, including color outputs 9, and an image sensor 6. The printed sheet 5 comprises color outputs 9. In the shown embodiment, the color outputs 9 comprise a strip 10 of color patches 11 that are printed near an edge of the sheet 5. The color patches 11 may comprise a number of patches of solid colors and a number of patches of gray colors. In an embodiment, a solid color patch consists of a sheet region with ink or toner of 100% coverage and a gray color patch consists of a sheet region with ink or toner of less than 100% coverage. The coverage may be indicated in Dot Area. In an embodiment, the color patches 11 are printed on the sheet 5 for mere calibration purposes. The color patches 11 may be printed outside of a print area 12 of the sheet 5, but on the same sheet 5 as the print area. The print area 12 is defined as the printed area of the sheet 5 that is used for the commercial end result, such as a book, folder, advertisement, letter, photo album, labels etc, and that contains the printed image. By printing the color patches 11 outside of the print area 12, the strip 10 comprising the color patches 11 can be removed after printing, for example using an inline or off line cutting device. The color patches 11 may be printed near a side of a respective sheet 5, for example near a top, bottom or side edge.

In an embodiment, the image sensor 6 comprises a densitometer or a spectrophotometer. In an embodiment, the image sensor 6 comprises an inline image sensor. The inline image sensor 6 is embedded in the print system 1, and arranged to measure the color outputs 9 during printing.

During printing, the sheets 5 pass along the image sensor 6, in a direction P. In the shown embodiment, the image sensor 6 is arranged to read the sides of the sheets 5, which contain the color patch strips 10. In the shown embodiment, the image sensor 6 is arranged to move to a side of the respective sheet 5. The image sensor 6 may be arranged to move along the width of the sheet 5, in a direction W.

In certain embodiments, the actual colors of the prints within the print area 12 are used as color outputs 9 for continuous calibration. An embodiment of this disclosure may be realized without printing color patches outside of the print area 12, but instead reading patches 11 inside the print area 12. In addition to, or instead of a densitometer, the image sensor 6 may comprise a camera, a scanner, a CCD or CMOS chip, or any other suitable optical sensor.

Figure 3:
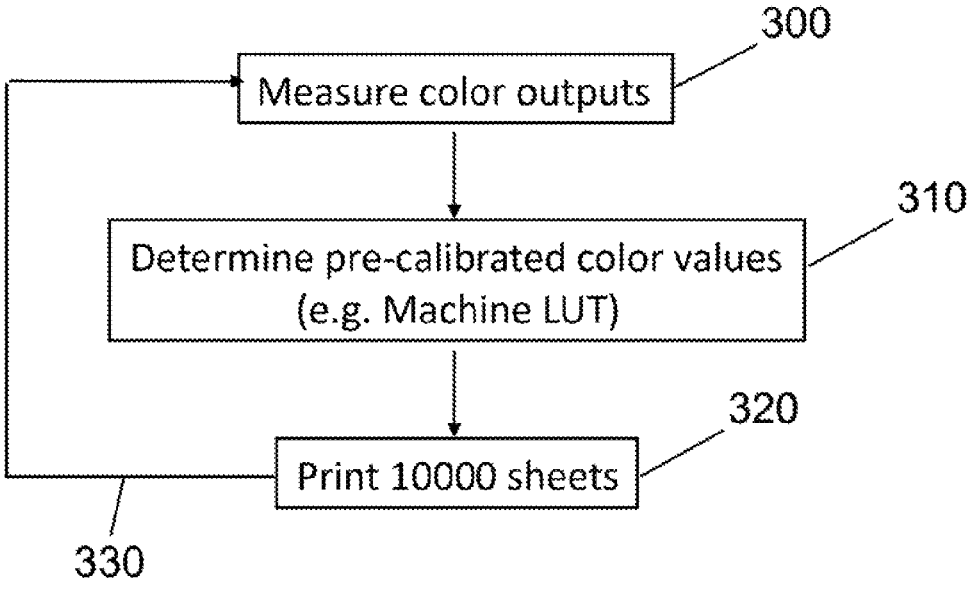
FIG. 3 represents a flow chart of an embodiment of a full color calibration.

FIG. 3 shows a flow chart of an embodiment of a process of performing a full color calibration. Such process may include a block 300 of measuring color outputs 9. For example, color patches and/or patterns are printed and thereafter read by the image sensor 6. In a block 310, pre-calibrated color values are calculated, based on the measured color outputs 9 for the corresponding digital inputs. In an embodiment, the pre-calibrated color values comprise a machine LUT. Digital inputs, color outputs, and/or certain print component states may be calibrated during the full color calibration. In an embodiment of the machine LUT fifteen given digital inputs are coupled to fifteen gray color outputs. The full color calibration may be performed on a regular basis, for example every ten thousand or twenty thousand prints, as indicated by block 320 and arrow 330. Between the full color calibrations the pre-calibrated color values remain constant. The print system 1 may be preprogrammed to indicate to an operator when a full color calibration is due, or, the operator may decide when to execute a full color operation regardless of a print system indication. In certain embodiments, the print system 1 is not available for printing commercial print jobs during the full color calibration.

Figure 4:
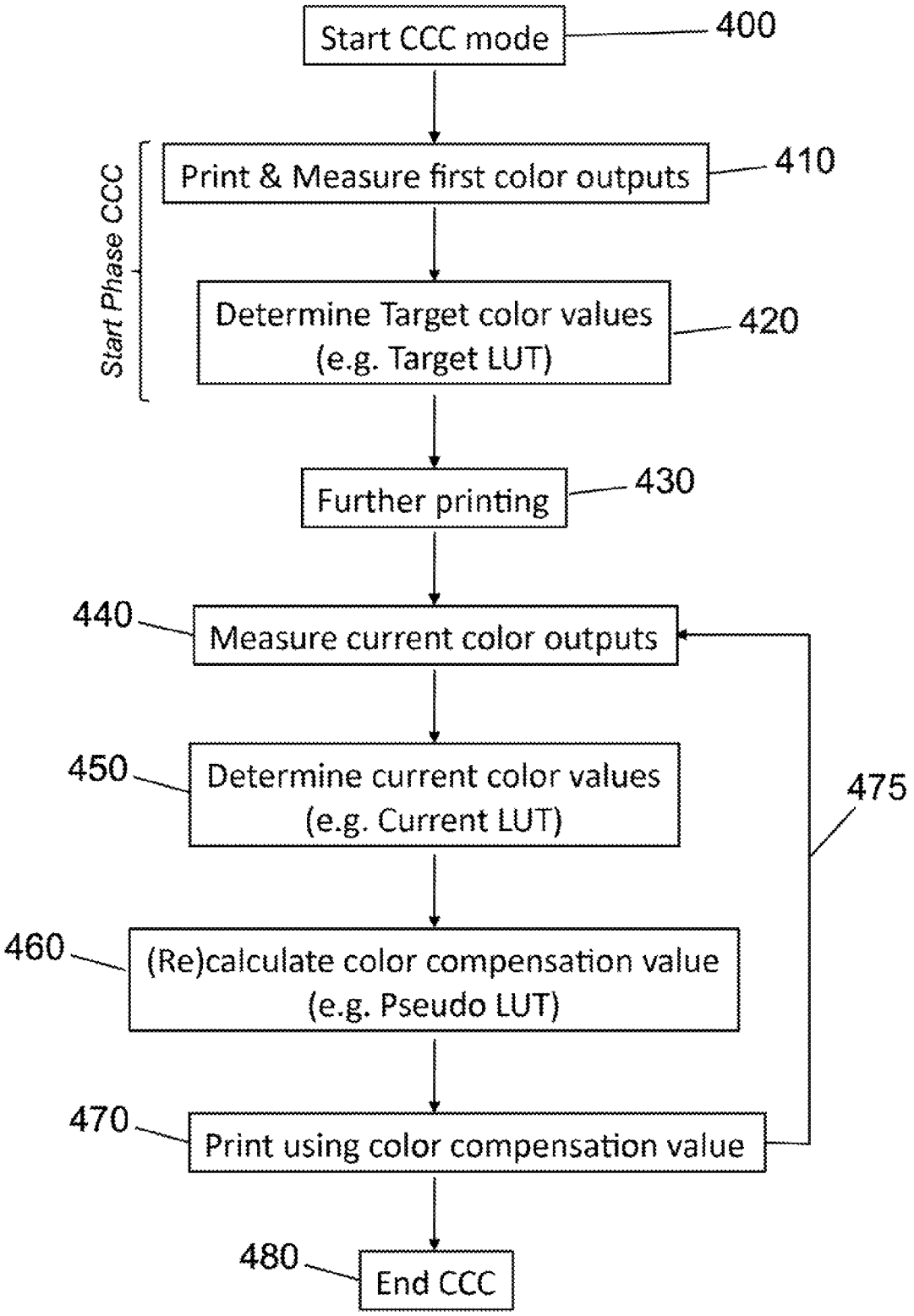
FIG. 4 represents a flow chart of an embodiment of a method of printing using continuous color calibration.

In an embodiment of this disclosure, the print system 1 is configured to execute continuous color calibration during printing. FIG. 4 represents a flow chart of an embodiment of a method of printing using continuous color calibration.

In the shown embodiment, the print system 1 is switched in a CCC (continuous color calibration) mode, for example at the start of a print job, as indicated by a first block 400. Another print mode may be a regular printing mode. The regular printing mode applies the pre-calibrated color values during printing.

At the start of the CCC mode, first color outputs 9 are printed on first sheets 5, as indicated by block 410. In an embodiment, the first color outputs 9 are printed using the pre-calibrated color values obtained during the regular full color calibration. For example, the first color outputs 9 are printed using the machine LUT. The first color outputs 9 are printed on one or more first sheets 5, in a start phase of the continuous color calibration. The first color outputs 9 are measured with the image sensor 6.

In a next block 420, target color values are determined based on the first color outputs 9. The blocks 410 and 420 may be referred to as a target collection block of the continuous calibration, wherein the first color outputs 9 may be defined as the desired color outputs 9 for the rest of the continuous color calibration. Since the operator chooses to activate continuous color calibration here, the desired color outputs 9 may be set at this point. In certain embodiments, the target collection may be performed when the operator activates it. For example the same target color values may be used for multiple continuous color calibrations and/or multiple print jobs. In other embodiments, target color values may be chosen to be recollected multiple times within the time a CCC mode is switched on and off.

The determined target color values may comprise a LUT, which may be defined as a target LUT. The target color values couple a number of given digital inputs to the corresponding first color outputs 9. The target color values are stored in the storage arrangement 7. The target color values may be updated each time a CCC mode is switched on, and may remain constant during the CCC mode. However, in certain embodiments, the target color values may be recollected while the print system 1 runs in the CCC mode. Also, a full color calibration may be performed while the print system 1 runs in a CCC mode.

In time, the first color outputs 9 may not correspond to the color outputs 9 of the machine LUT, because a print component state may have changed since the last full color calibration. For example, print component states such as temperatures, toner conductivity, toner density, substrate color or material, certain material properties, ink properties, toner properties, binary ink developer properties, and/or other states may have changed since the last full color calibration.

In a further block 430, the print job is continued. Current color outputs 9 are printed onto one or more sheets 5. The current color outputs 9 are the outputs 9 printed and measured continuously, whereas the first color outputs 9 are the outputs 9 that are printed and measured in a start phase of the continuous color calibration only. The current color outputs 9 are measured inline by the image sensor 6, as indicated by block 440.

Subsequently, current color values are determined, based on the current color outputs 9, as indicated by block 450. The current color values couple the respective digital inputs with the corresponding current color outputs 9. In an embodiment, the current color values comprise a LUT, defined as a current LUT. The current color values are determined by the processor 8. Since the current color outputs 9 may be different for each print, the current color value is a temporary value. The current color values are continuously updated in the storage arrangement 7 during printing. In the start phase of the continuous color calibration, the current color values are equal to the target color values. Afterwards, the current color values and the target color values may be different due to a change in a print component state.

In a further block 460, color compensation values are calculated. The color compensation values compensate for a difference between the target color values and the current color values. The color compensation values may couple a desired color output with a more correct digital input. The color compensation value may comprise a LUT, herein defined as a pseudo LUT. Also color compensation values are calculated by the processor 8 and stored in the storage arrangement 7.

As the printing continues, in block 470, the color compensation values are used to couple the digital input with the color output, to obtain the desired color outputs 9. The color compensation values may be continuously recalculated and updated in the storage arrangement 7. As indicated with the loop-arrow 475, the current color values are repetitively determined for new prints. Consequently, the color compensation values are repetitively recalculated, and printing is executed using the updated color compensation values. In this way, a change in one or more print components states may be continuously compensated by the color compensation value. The color compensation value represents a temporary value. Note that the blocks 430 to 470 may actually take place at the same time and that this explanation serves to illustrate the principle.

In one embodiment, continuous color calibration using said color compensation values is applied without changing the respective print component state and/or without changing the pre-calibrated color values. In other embodiments, the print component state that causes the change in color outputs 9 may be identified and calibrated while continuing running the continuous color calibration by calculating the color compensation values.

The continuous color calibration achieves relatively consistent colors during printing, for example across a full print job that is printed in the CCC mode. The CCC mode may be switched off, for example at the end of a print job, as indicated by block 480.

Figure 5:
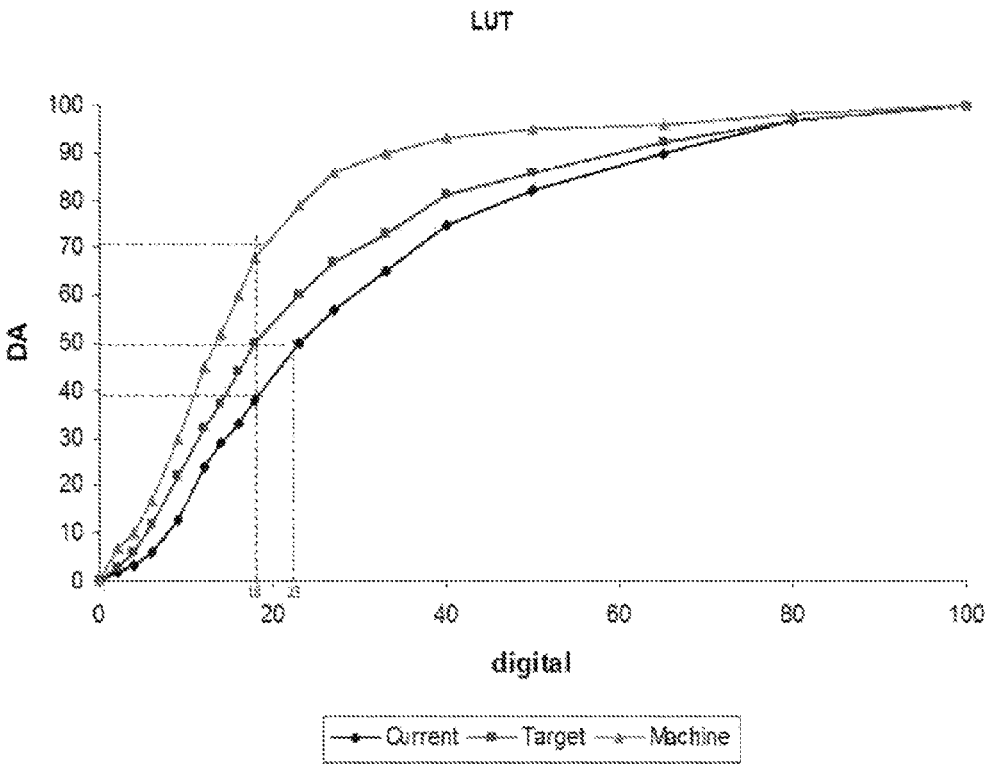
FIG. 5 illustrates an embodiment of a graph of a machine LUT, a target LUT and a current LUT, of an embodiment of a print system.

FIG. 5 shows an embodiment of a graph of a machine LUT, a target LUT and a current LUT, of an embodiment of a print system 1. The horizontal axis represents the digital input, and the vertical axis represents the color output, in dot area coverage percentages. For example, each LUT has 15 grays having respective dot area coverages of more than between 0% and less than 100%.

The top graph represents a machine LUT. In the shown exam when the full color calibration was completed a digital input of approximately 18% yielded a color output 9 of approximately 70%. A certain time period after completion of the full color calibration, the continuous color calibration was activated. The target LUT was determined in the start phase of the continuous color calibration. The target LUT is represented by the middle graph. As can be seen, the same digital inputs of 18% yielded a first color output 9 of approximately 50%. During the subsequent phases of the continuous color calibration the operator wanted to print equal or at least similar color outputs 9 as the first color outputs 9, which are the desired color outputs.

After further printing, the current color outputs of the digital input of approximately 18% appeared to output a color output 9 of approximately 40%, as can be seen from the bottom graph that represents the current LUT. For example, a digital input of approximately 23% would have output the desired color output 9 of 50%, with the current print component states, as can be seen from the current LUT graph. Therefore, a pseudo LUT is calculated to couple the desired color outputs, as obtained at target collection, with the correct digital inputs. The pseudo LUT is used to provide the digital inputs for the desired color outputs 9.

The pseudo LUT is defined as follows:

$$P=M(T^{-1}(C(\text{digital input}))), \text{ and}$$

$$P^{-1}-C^{-1}(T(M^{-1}(\text{desired color output}))).$$

In the above formulas, P is the pseudo LUT, C is the current. LUT, T is the target LUT, and M is the machine LUT. These formulas are stored in the storage arrangement 7. The formulas are applied by the processor 8. The pseudo LUT is calculated, re-calculated and applied by the processor 8. In an embodiment, first the desired color outputs are determined. With the desired color outputs, the pseudo LUT is calculated and recalculated continuously. With the pseudo LUTs, the digital inputs for achieving the desired color outputs in the current print component state may be calculated.

In an embodiment, an operator can activate the continuous color calibration at any time, from which time onwards a relative color consistency may be maintained, irrespective of when the full color calibration is performed.

The above description is not intended to be exhaustive or to limit the invention to the embodiments disclosed. Other variations to the disclosed embodiments can be understood and effected by those skilled in the art in practicing the claimed invention, from a study of the drawings, the disclosure, and the appended claims. The indefinite article "a" or "an" does not exclude a plurality, while a reference to a certain number of elements does not exclude the possibility of having more or less elements. A single unit may fulfil the functions of several items recited in the disclosure, and vice versa several items may fulfil the function of one unit.

In the following claims, the mere fact that certain measures are recited in mutually different dependent claims does not indicate that a combination of these measures cannot be used to advantage. Multiple alternatives, equivalents, variations and combinations may be made without departing from the scope of the invention.

What is claimed is:

1. A method of continuous color calibration of a printing device, the method performed by a processor of the printing device and comprising:

in a normal operation mode, executing print jobs based on pre-calibrated color values;

in a continuous color calibration mode:

(a) printing first color outputs in a start phase of the continuous color calibration mode;

(b) measuring the first color outputs to determine target color values for a print job;

(c) storing the target color values;

(d) printing current color outputs within a print area of the print job;

(e) measuring the current color outputs to determine current color values;

(f) storing the current color values;

(g) calculating color compensation values to compensate for a difference between the target color values and the current color values;

(h) storing the color compensation values;

(i) continuing the print job using the color compensation values; and repetitively performing steps (d)-(i) across the print job, such that color compensation values are repetitively recalculated during the print job, and portions of the print job are printed using the color compensation values, wherein the color outputs, the first color outputs, and the current color outputs further comprise strips of color patches printed on respective print sheets, outside of a print area, and wherein the color outputs, the first color outputs, and the current color outputs are measured using an image sensor of the printing device.

2. The method of claim 1, wherein the pre-calibrated color values remain constant in the continuous color calibration mode and the normal operation mode.

3. The method of claim 1, wherein the printing device includes an input feature to switch the printing device between the normal operation mode and the continuous color calibration mode, the method further comprising:

in response to the printing device being switched to the continuous color calibration mode, printing a new set of current color outputs;

measuring the new set of current color outputs to determine a new set of target color values; and updating the target color values based on the new set of target color values.

4. The method of claim 1, wherein recalculating the color compensation values comprises:

storing the color compensation values as a pseudo look up table (LUT);

storing the current color values as a current LUT;

storing the target color values as a target LUT;

storing the pre-calibrated color values as a machine LUT;

calculating P−1=C−1(T(M−1(target output))) or P=M(T−1(C(digital input))), and wherein:

P is the pseudo LUT,

C is the current LUT,

T is the target LUT, and

M is the machine LUT.

5. A print system, comprising:

an image transfer arrangement;

an image sensor for measuring color values of color outputs;

a storage arrangement storing pre-calibrated color values; and a processor configured to:

in a normal operation mode, execute print jobs based on the pre-calibrated color values;

in a continuous color calibration mode:

(a) print first color outputs in a start phase of the continuous color calibration mode;

(b) measure the first color outputs using the image sensor to determine target color values for a print job;

(c) store the target color values;

(d) print current color outputs within a print area of the print job;

(e) measure the current color outputs to determine current color values;

(f) store the current color values;

(g) calculate color compensation values to compensate for a difference between the target color values and the current color values;

(h) store the color compensation values;

(i) continue the print job using the color compensation values; and repetitively perform steps (d)-(i) across the print job, such that color compensation values are repetitively recalculated during the print job, and sheets of the print job are printed using the recalculated color compensation values, wherein to recalculate the color compensation values the processor is further configured to:

store the color compensation values as a pseudo look up table (LUT);

store the current color values as a current LUT;

store the target color values as a target LUT;

store the pre-calibrated color values as a machine LUT;

calculate P−1=C−1(T(M−1(target output))) or P=M(T−1(C(digital input))), and wherein:

P is the pseudo LUT,

C is the current LUT,

T is the target LUT, and

M is the machine LUT.

6. The print system of claim 5, wherein the image sensor comprises an inline image sensor.

7. The print system of claim 5, wherein the storage arrangement stores the pre-calibrated color values to enable the processor to convert digital inputs, corresponding to the print job, to the respective pre-calibrated color values.

8. The print system of claim 5, wherein the pre-calibrated color values remain constant in the continuous color calibration mode and the normal operation mode.

9. The print system of claim 5, further comprising an input feature to switch the printing device between the normal operation mode and the continuous color calibration mode, and the processor is further configured to:

in response to being switched to the continuous color calibration mode, print a new set of current color outputs;

measure the new set of current color outputs to determine a new set of target color values; and update the target color values based on the new set of target color values.

10. The print system of claim 5, wherein the color outputs, the first color outputs, and the current color outputs further comprise strips of color patches printed on respective print sheets, outside of a print area, and wherein the color outputs, the first color outputs, and the current color outputs are measured using an image sensor.

* * * * *